US010845156B1

(12) United States Patent
Fortin

(10) Patent No.: US 10,845,156 B1
(45) Date of Patent: Nov. 24, 2020

(54) PISTOL FRAME

(71) Applicant: Armscor Global Defense, Inc., Marikina (PH)

(72) Inventor: Ernesto Roque Fortin, Marikina (PH)

(73) Assignee: ARMSCOR GLOBAL DEFENSE, INC., Marikina (PH)

( * ) Notice: Subject to any disclaimer, the term of this patent is extended or adjusted under 35 U.S.C. 154(b) by 0 days.

(21) Appl. No.: 16/531,251

(22) Filed: Aug. 5, 2019

(51) Int. Cl.
*F41C 23/10* (2006.01)
*F41A 3/66* (2006.01)

(52) U.S. Cl.
CPC ..... *F41C 23/10* (2013.01); *F41A 3/66* (2013.01)

(58) Field of Classification Search
CPC ..... F41C 23/10; F41C 23/14; F41C 23/16; F41C 23/18; F41C 23/04; F41C 23/64; F41A 3/66
USPC ..... 42/71.02
See application file for complete search history.

(56) References Cited

U.S. PATENT DOCUMENTS 4,463,654 A * 8/1984 Barnes ..... F41A 19/09 42/74
5,195,226 A * 3/1993 Bornancini ..... B21D 53/00 228/173.6
7,472,507 B2 * 1/2009 Curry ..... F41A 19/15 42/14
7,937,877 B2 * 5/2011 Barrett ..... F41A 3/66 42/75.1
9,015,981 B2 * 4/2015 Zamlinsky ..... F41C 23/22 42/75.03
9,115,954 B1 * 8/2015 Corsi ..... F41A 1/06
9,163,895 B2 * 10/2015 Pedersen ..... B23P 15/00
9,677,846 B1 * 6/2017 Vankeuren, III ..... F41C 23/00
2005/0188585 A1 * 9/2005 Vicate ..... F41C 23/18 42/71.01
2014/0075803 A1 * 3/2014 Muller ..... F41A 19/09 42/16
2017/0350665 A1 * 12/2017 Borges ..... F41A 3/66
2018/0202737 A1 * 7/2018 Ferguson ..... F41A 11/02
(Continued)

OTHER PUBLICATIONS

NPL: http://survincity.com/2011/01/innovative-pistol-kel-tec-pmr-30/ Jan. 16, 2011.*
(Continued)

*Primary Examiner* — John Cooper
(74) *Attorney, Agent, or Firm* — Bennet K. Langlotz; Langlotz Patent & Trademark Works, LLC

(57) ABSTRACT

Pistol frames have a pair of opposed frame shells, the frame shells separable contacting each other at a medial plane, the shells defining a plurality of registered apertures configured to receive a plurality of registration elements, and the shells collectively defining a rail receptacle configured to receive a rail module. The shells may be formed of metal and be an integral unitary element. The shells may define a plurality of receptacles each configured to receive a rail module. The shells may at least in part define a magazine well having opposed sidewalls. The rail receptacle may be in open communication with the magazine well. The magazine well may have opposed side surfaces and opposed front and rear surfaces, the rear surface extending from a lower grip end of the frame and having an upper terminus at an intermediate location spaced apart from an upper limit of the frame.

22 Claims, 5 Drawing Sheets

(56) References Cited

U.S. PATENT DOCUMENTS

| | | | | |
|---|---|---|---|---|
| 2019/0118325 | A1* | 4/2019 | Patel | F41A 11/02 |
| 2019/0154368 | A1* | 5/2019 | Kim | F41A 11/02 |

OTHER PUBLICATIONS

NPL-2: https://www.youtube.com/watch?v=fXXyLDFw4PM Jan. 4, 2019, "Machining Frames and Slides—Insdie Wilson w/Ken Hackathorn—Ep. 04".*

* cited by examiner

PISTOL FRAME

FIELD OF THE INVENTION

The present invention relates to firearms and more particularly to a pistol frame.

BACKGROUND OF THE INVENTION

Conventional pistol frames are often stamped from sheet metal, forming two mirror-image pieces that are fitted together like a clamshell. After stamping, various machining operations are still required, including drilling holes for pins and screws. Although CNC machining has made these finishing processes less tedious, they can still be time consuming and expensive.

Therefore, a need exists for a new and improved pistol frame that can be manufactured from an extrusion to reduce machining time and associated expense. In this regard, the various embodiments of the present invention substantially fulfill at least some of these needs. In this respect, the pistol frame according to the present invention substantially departs from the conventional concepts and designs of the prior art, and in doing so provides an apparatus primarily developed for the purpose of providing a pistol frame that can be manufactured from an extrusion to reduce machining time and associated expense.

SUMMARY OF THE INVENTION

The present invention provides an improved pistol frame, and overcomes the above-mentioned disadvantages and drawbacks of the prior art. As such, the general purpose of the present invention, which will be described subsequently in greater detail, is to provide an improved pistol frame that has all the advantages of the prior art mentioned above.

To attain this, the preferred embodiment of the present invention essentially comprises a pair of opposed frame shells, the frame shells separable contacting each other at a medial plane, the shells defining a plurality of registered apertures configured to receive a plurality of registration elements, and the shells collectively defining a rail receptacle configured to receive a rail module. The shells may be formed of metal. Each shell may be an integral unitary element. The shells may define a plurality of receptacles each configured to receive a rail module. The shells may at least in part define a magazine well having opposed sidewalls. The rail receptacle may be in open communication with the magazine well. The magazine well may have opposed side surfaces and opposed front and rear surfaces, the rear surface extending from a lower grip end of the frame and having an upper terminus at an intermediate location spaced apart from an upper limit of the frame. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
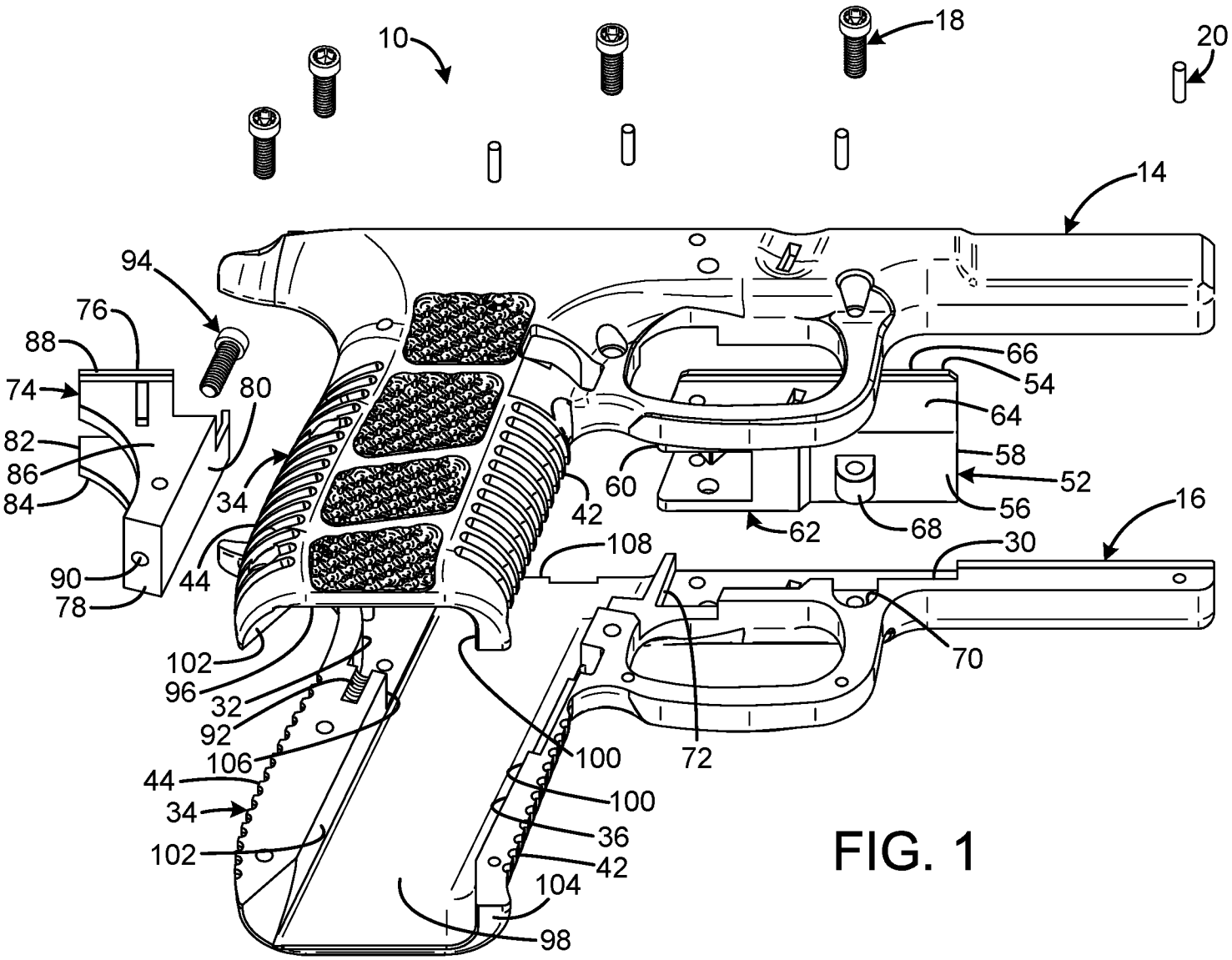
FIG. 1 is an exploded view of the current embodiment of the pistol frame constructed in accordance with the principles of the present invention.

An embodiment of the pistol frame of the present invention is shown and generally designated by the reference numeral 10.

Figure 3:
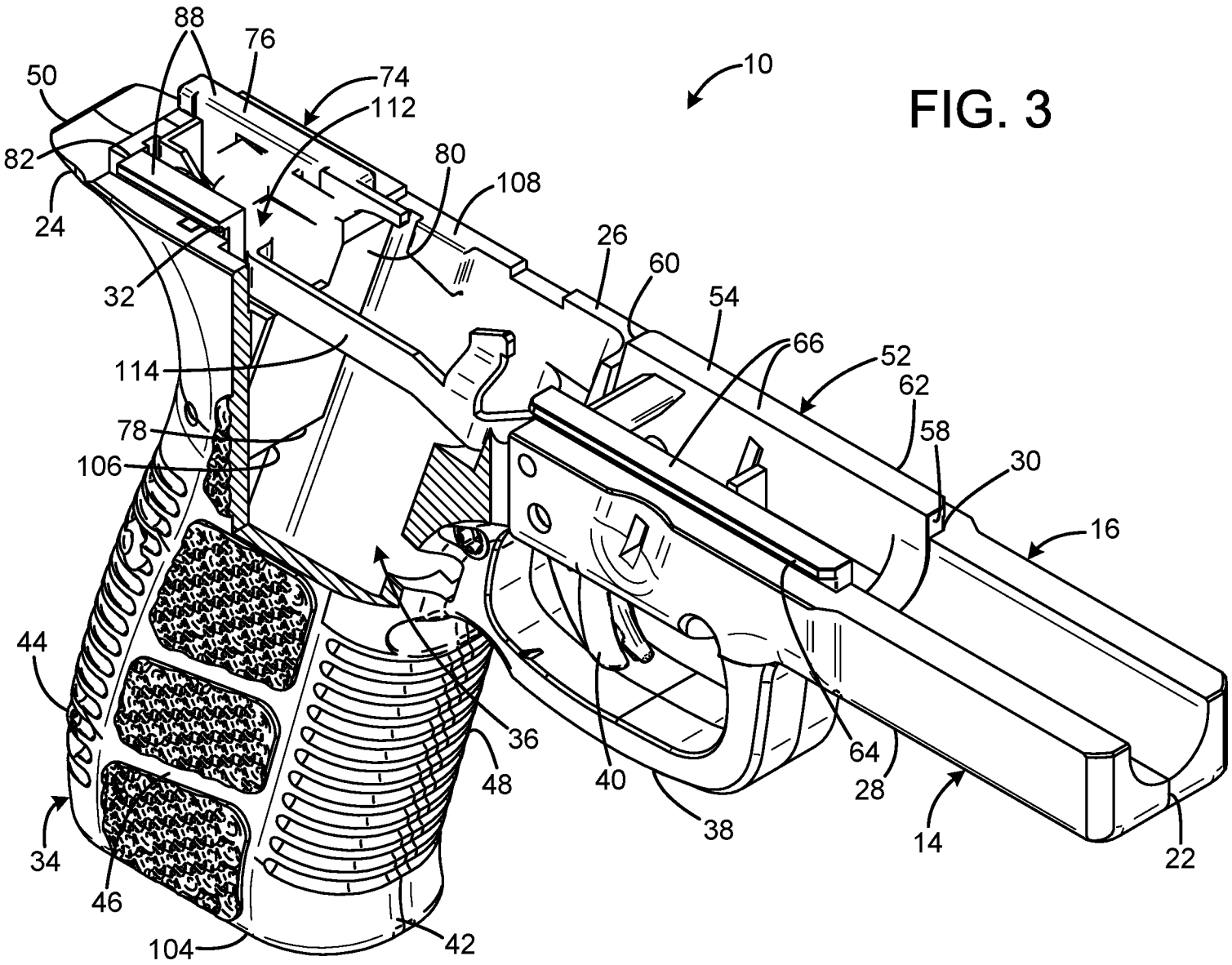
FIG. 3 is a front isometric view of the current embodiment of the pistol frame of FIG. 1.

FIGS. 1 & 3 illustrate the improved pistol frame 10 of the present invention. More particularly, the pistol frame has a right half 14 and a left half 16. The right half and left half are frame shells formed of metal, preferably aluminum, in the current embodiment. Each is an integral unitary element. All the internal parts are captured between the right and left halves. The pistol frame is held together by retaining screws 18 and retaining pins 20 such that the right and left halves separably contact each other at a medial plane. The retaining screws and retaining pins are a plurality of registration elements that are received in a plurality of registered apertures defined by the left and right halves. Although many of the features of the pistol frame that will be described result from the mating of the right half with the left half, the features of the pistol frame will be described as if the frame were of unitary construction. The pistol frame has a front 22, rear 24, top 26, and bottom 28. The top of the pistol frame has a hollow interior that defines a front rail receptacle 30 and a rear rail receptacle 32. The bottom rear of the pistol frame forms a rear grip 34 adapted for gripping by a user, defines a magazine well 36, and forms a trigger guard 38. A trigger 40 protrudes forwardly from the bottom of the pistol frame into a space defined by the trigger guard. The rear grip optionally includes ball nose serrations on the front strap 42 and rear strap 44 and machine raised grip panels on the right and left sides 46, 48 to improve grip. The top rear of the pistol frame forms a beavertail 50. A trigger bar 112 extends from forward of the magazine well to rearward of the magazine well. In the current embodiment, the magazine well is sized to receive magazines (not shown) compatible with Glock® pistols.

The front rail receptacle 30 of the pistol frame 10 is configured to receive a front chassis/rail module 52. The front chassis has a top 54, bottom 56, front 58, rear 60, left side 62, and right side 64. The top right and left sides of the front chassis include front slide rails 66. The bottom of the front chassis includes a lug 68. The lug is received in a lug recess 70 defined by the frame and threadedly secured to the frame by a retaining screw 18. The rear 72 of the front rail receptacle is also angled forward to prevent undesirable upward movement of the rear of the front chassis as the slide (not shown) recoils. The removability of the front chassis from the pistol frame enables replacement of the front slide rails in case of unexpected wear. In the current embodiment, the front chassis is made of hardened steel, but does not exceed the hardness of the slide.

The rear rail receptacle 32 of the pistol frame 10 is configured to receive a rear chassis/rail module 74. The rear chassis has a top 76, bottom 78, front 80, rear 82, left side 84, and right side 86. The top right and left sides of the rear chassis include rear slide rails 88. The bottom of the rear chassis includes a threaded aperture 90. The threaded aperture is registered with a threaded aperture 92 defined by the frame when the rear chassis is received by the rear rail receptacle. The rear chassis is threadedly secured to the pistol frame by a rear chassis locking screw 94. The removability of the rear chassis from the pistol frame enables replacement of the rear slide rails in case of unexpected wear. In the current embodiment, the rear chassis is made of hardened steel, but does not exceed the hardness of the slide.

Figure 2:
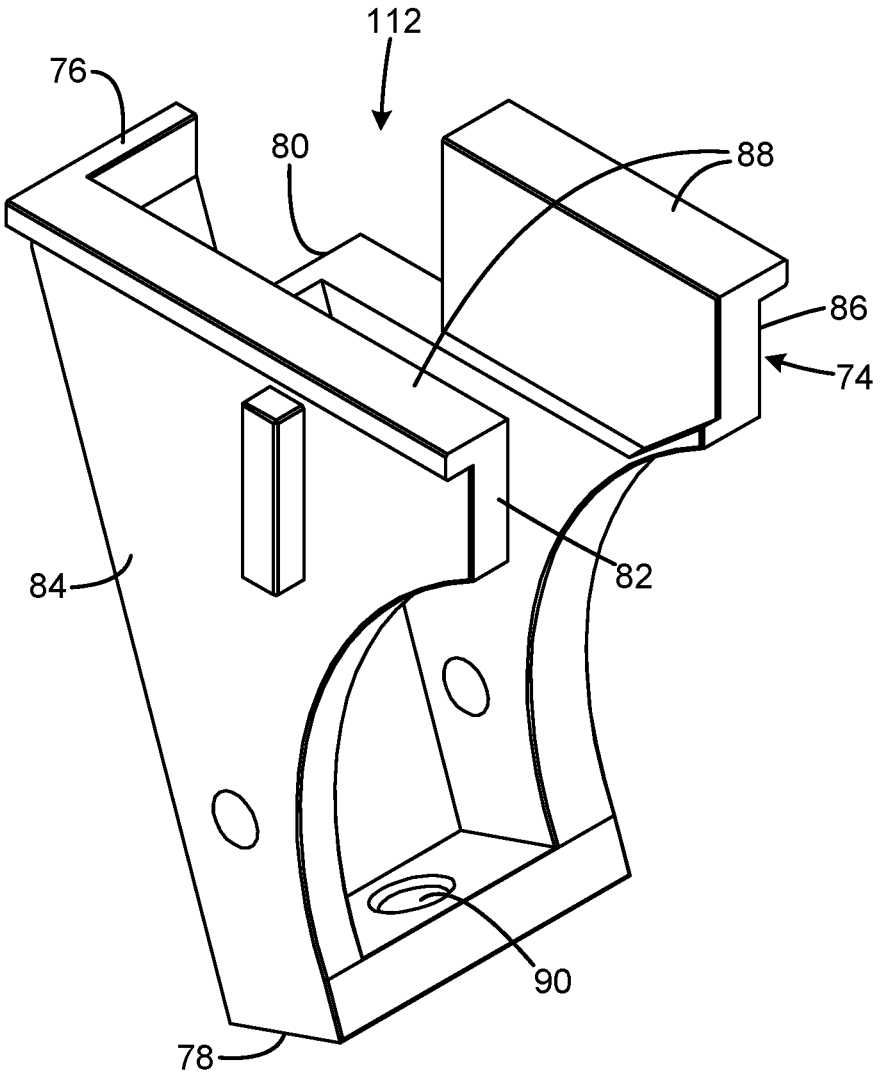
FIG. 2 is a rear isometric view of the current embodiment of the rear chassis of FIG. 1.

FIG. 2 illustrates the improved rear chassis 74 of the pistol frame 10 of the present invention. More particularly, the front 80 of the rear chassis 74, which is a flat front surface, extends to a lower end (bottom 78) of the rear chassis. The front of the rear chassis defines a passage 112 that receives a portion of the trigger bar 114 (trigger bar shown in FIG. 3).

Figure 4:
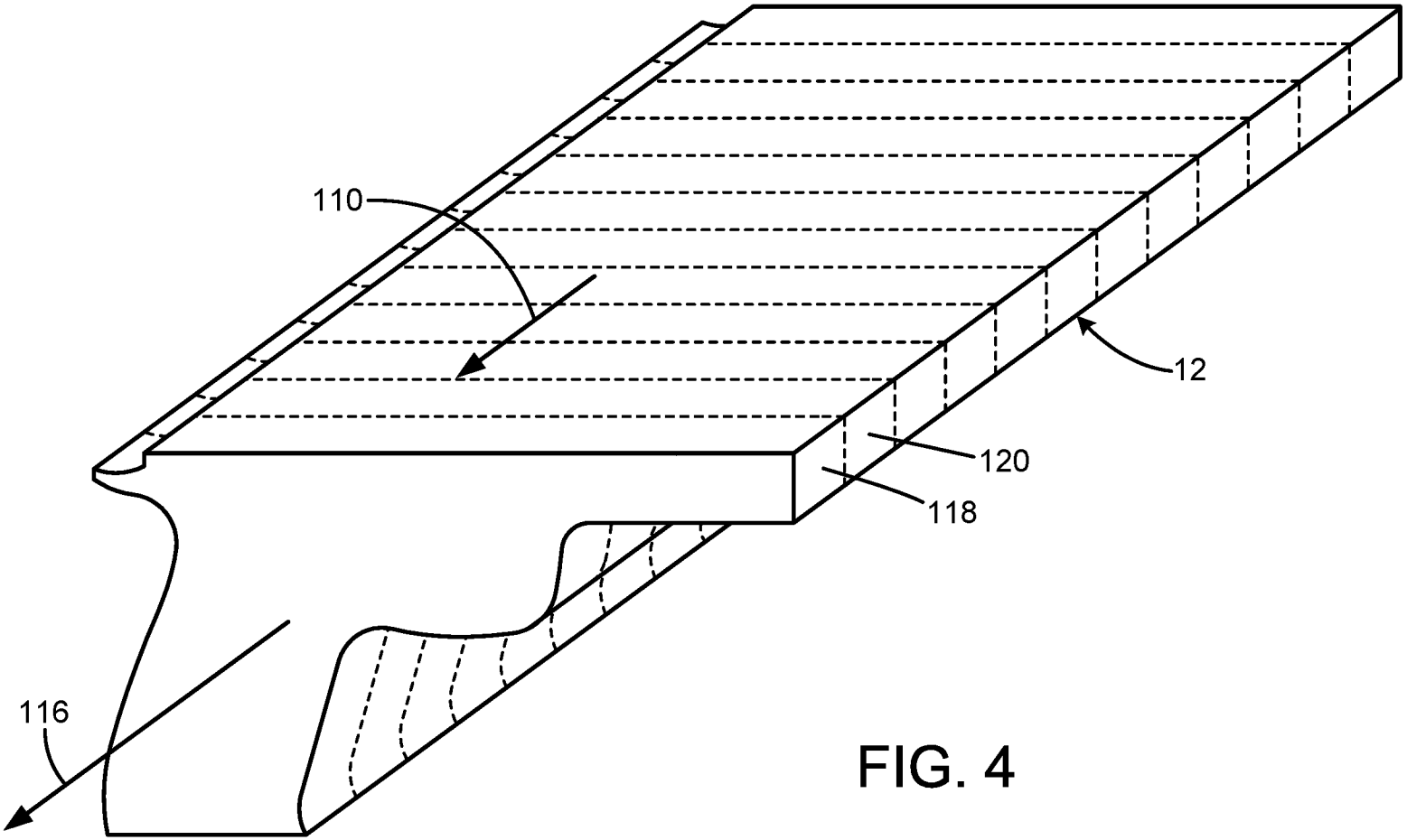
FIG. 4 is a side isometric view of the extrusion used to manufacture the current embodiment of the pistol frame of FIG. 1.

FIG. 4 illustrates the improved extrusion 12 of the pistol frame 10 of the present invention. More particularly, the extrusion is an aluminum element that is machined to form the right and left halves 14, 16 of the pistol frame 10. Each half/shell of the pistol frame defines a primary plane, and each has an extrusion grain structure (denoted by arrow 110) oriented perpendicularly to the primary plane and parallel to the direction of the line of travel (denoted by arrow 116) of the extruded material as it is pushed and/or pulled through the extrusion die (not shown). While extrusion grain structure is normally desired to extend along the length of elongated elements for structural strength, the invention orients contrary to this conventional approach to achieve the unexpected benefit of greatly reducing the amount of material that must be machined from the raw workpiece (sliced off the extrusion). "Metal extrusion tends to produce an elongated grain structure, usually considered favorable, in the part's material in the direction that the work is extruded," https://thelibraryofmanufacturing.com/extrusion.html.

To produce the right and left halves 14, 16 of the pistol frame 10, a suitable material, preferably 7075 aircraft aluminum alloy, is extruded through a form having the general exterior shape of the right and left frame halves. The extrusion is subsequently sliced into right and left half frame workpieces 118, 120. The right and left half frame workpieces are then machined into the finished right and left frame halves. It should be appreciated that many features of the finished right and left frame halves are already substantially present on the right and left half frame workpieces, such as the beavertail, rear grip, exterior of the trigger guard, and the exterior, top, and front of the right and left frame halves. Thus, substantially less machining time is required to produce the right and left frame halves from the right and left half frame workpieces than would be required to produce the right and left frame halves from rectangular blocks of material. The reduction in machining time means that more right and left frame halves can be produced from a machine tool than would otherwise be the case, which reduces the cost of machining per right and left frame half. Less material removal from the right and left half frame workpieces also results in less material potentially being wasted or requiring recycling to be made usable again, which also reduces the cost of producing each right and left frame half. In the current embodiment, each right frame workpiece weighs XX oz., each finished right frame half weighs XX oz, each left frame workpiece weighs XX oz., and each finished left frame half weighs XX oz.

Figure 5:
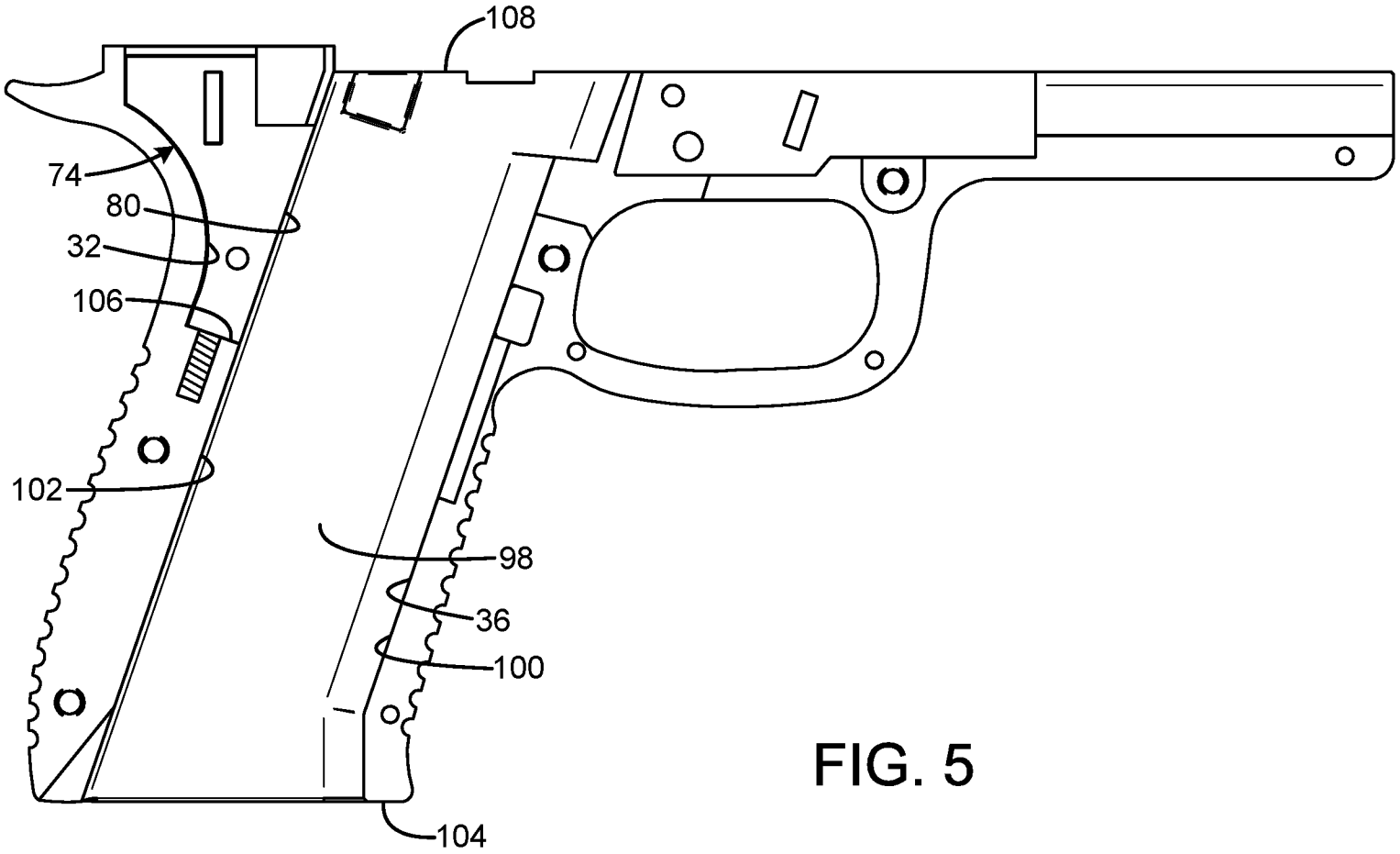
FIG. 5 is a right side view of the current embodiment of the left frame of FIG. 1.

FIG. 5 illustrates the improved left half 16 of the pistol frame 10 of the present invention. More particularly, the rear rail receptacle 32 is in open communication with the magazine well 36 such that the front 80 of the rear chassis 74, which is a flat front surface, in part defines the magazine well. The magazine well has opposed sidewalls with opposed side surfaces 96, 98 and opposed front and rear surfaces 100, 102. The rear surface of the magazine well extends from a lower grip end 104 of the pistol frame and has an upper terminus at an intermediate location 106 spaced apart from an upper limit 108 of the frame. Each half of the pistol frame defines a portion of the rear surface of the magazine well occupying a common plane. The front of the rear chassis occupies the common plane and forms a smooth and continuous surface with the rear surface of the magazine well. The magazine well and the rear rail receptacle form a common space without an intervening separator. The front of the rear chassis extends to the opposed side surfaces and a full width of the magazine well.

While a current embodiment of a pistol frame has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pistol frame comprising:

a frame body defining a rail receptacle configured to receive a rail module;

the frame body at least in part defining a magazine well having opposed sidewalls; and the rail receptacle having a lower end in open communication with the magazine well.

2. The pistol frame of claim 1 wherein the magazine well has opposed side surfaces and opposed front and rear surfaces, the rear surface extending from a lower grip end of the frame and having an upper terminus at an intermediate location spaced apart from an upper limit of the frame.

3. The pistol frame of claim 1 wherein the rail module has a flat front surface in part defining the magazine well.

4. The pistol frame of claim 3 wherein the flat front surface extends to a lower end of the rail module.

5. The pistol frame of claim 3 wherein the magazine well has opposed side surfaces, and the flat front surface of the rail module extends to the opposed side surfaces.

6. The pistol frame of claim 3 wherein the flat front surface of the rail module extends to a full width of the magazine well.

7. The pistol frame of claim 3 wherein the flat front surface defines a passage configured to receive a portion of a trigger bar.

8. The pistol frame of claim 7 wherein the trigger bar extends from forward of the magazine well to rearward of the magazine well.

9. A pistol frame comprising:

a frame body defining a rail receptacle configured to receive a rail module;

the frame body at least in part defining a magazine well having opposed sidewalls; and wherein the magazine well and the rail receptacle form a common space without an intervening separator.

10. The pistol frame of claim 9 wherein the rail module has a flat front surface in part defining the magazine well.

11. The pistol frame of claim 10 wherein the flat front surface extends to a lower end of the rail module.

12. The pistol frame of claim 10 wherein the magazine well has opposed side surfaces, and the flat front surface of the rail module extends to the opposed side surfaces.

13. The pistol frame of claim 10 wherein the flat front surface of the rail module extends to a full width of the magazine well.

14. The pistol frame of claim 10 wherein the flat front surface defines a passage configured to receive a portion of a trigger bar.

15. The pistol frame of claim 14 wherein the trigger bar extends from forward of the magazine well to rearward of the magazine well.

16. A pistol frame comprising:

a frame body defining a rail receptacle configured to receive a rail module;

the frame body at least in part defining a magazine well having opposed sidewalls; and a rail module received in the rail receptacle, the rail module in part defining the magazine well.

17. The pistol frame of claim 16 wherein the rail module has a flat front surface in part defining the magazine well.

18. The pistol frame of claim 17 wherein the flat front surface extends to a lower end of the rail module.

19. The pistol frame of claim 17 wherein the magazine well has opposed side surfaces, and the flat front surface of the rail module extends to the opposed side surfaces.

20. The pistol frame of claim 17 wherein the flat front surface of the rail module extends to a full width of the magazine well.

21. The pistol frame of claim 17 wherein the flat front surface defines a passage configured to receive a portion of a trigger bar.

22. The pistol frame of claim 21 wherein the trigger bar extends from forward of the magazine well to rearward of the magazine well.

* * * * *